US005804115A

United States Patent [19]

Burton et al.

[11] Patent Number: 5,804,115

[45] Date of Patent: Sep. 8, 1998

[54] ONE STEP, READY-TO-TUFT, MOCK SPACE-DYED MULTIFILAMENT YARN

[75] Inventors: Wendel L. Burton, Arden; Robert H. Blackwell, Candler, both of N.C.

[73] Assignee: BASF Corporation, Mt. Olive, N.J.

[21] Appl. No.: 766,724

[22] Filed: Dec. 13, 1996

[51] Int. Cl.[6] ..... D02G 3/00; D02J 1/08

[52] U.S. Cl. ..... 254/103; 28/220; 28/221; 28/245; 28/247; 28/263; 28/271; 264/171.13; 264/210.8; 264/211.12

[58] Field of Search ..... 264/103, 171.13, 264/210.8, 211.12; 28/220, 221, 245, 247, 263, 271

[56] References Cited

U.S. PATENT DOCUMENTS

| | | | |
|---|---|---|---|
| Re. 35,108 | 12/1995 | Hagen et al. | 264/176.1 |
| 3,780,516 | 12/1973 | Kimbrell | 57/157 |
| 4,025,595 | 5/1977 | Mirhej | 264/103 |
| 4,408,376 | 10/1983 | Hatcher et al. | 28/245 |
| 4,993,130 | 2/1991 | Coons, III et al. | 28/271 |
| 5,148,586 | 9/1992 | Coons, III | 28/271 |
| 5,184,381 | 2/1993 | Coons, III et al. | 28/271 |
| 5,220,778 | 6/1993 | Flachmueller et al. | 57/333 |
| 5,251,363 | 10/1993 | Gerhards et al. | 28/221 |
| 5,327,622 | 7/1994 | Coons et al. | 28/220 |
| 5,613,285 | 3/1997 | Chester et al. | 28/247 |

FOREIGN PATENT DOCUMENTS

| | | |
|---|---|---|
| 350 450 | 1/1990 | European Pat. Off. . |
| 0 784 109 | 7/1997 | European Pat. Off. . |

OTHER PUBLICATIONS

U.S. application Ser. No. 08/333,158, filed Nov. 1, 1994.
U.S. application Ser. No. 08/622,196, filed Mar. 25, 1996.
Translation of Europe 784,109 (Published Jul. 16, 1997).

*Primary Examiner*—Leo B. Tentoni

[57] ABSTRACT

A process for making ready-to-tuft, mock space-dyed bulked continuous filament yarn is a one-step process. It joins extruding, texturing, and interlacing to yield a yarn that may be tufted directly into carpet without further texturing or twisting. In another aspect, one or more additional strands may be inserted in the process. An apparatus for making the ready-to-tuft, mock space-dyed, bulked continuous filament yarn is described.

20 Claims, 2 Drawing Sheets

ONE STEP, READY-TO-TUFT, MOCK SPACE-DYED MULTIFILAMENT YARN

FIELD OF THE INVENTION

The present invention relates to bulked continuous filament yarns made from differently colored filaments and processes for making them.

BACKGROUND OF THE INVENTION

As used herein, certain terms have the meanings ascribed to them as follows:

"Filament or filaments" means fibrous strands of extreme or indefinite length. In contrast, "staple fibers" are fibrous strands of definite and short lengths.

"Yarn" means a continuous assemblage of filaments twisted or laid together.

"Interlacing" and "entangling" refer to a method of wrapping or knotting fibers about each other, by mechanical means, or by the use of jets of pressurized gas or fluid, so as to periodically bind the fibers.

"Multicolor yarn" means an assemblage of two or more filaments or groups of filaments which are differently colored or colorable with respect to each other.

"Strand" means an ordered assemblage of filaments having a high ratio of length to width and used as a unit. Exemplary strands include plies and singles yarns.

"One-step" means a process for making yarn where the yarn is not wound-up between spinning, drawing, texturing or interlacing.

"Color pop" refers to the color effect in yarn exhibiting the clarity of one or more segments along the fiber bundle.

Carpet manufacturers are continually searching for yarns which provide distinct visual appearance when converted into cut pile or loop carpet styles. These visual effects are often the result of color effects built into the carpet yarn. Sometimes, these color effects are caused by differently colored filaments combined in various ways into a plied yarn. These filaments may be colored in the melt or after spinning. Another method for preparing novel color effects is by space dyeing. Exemplary color effect yarns and processes for making them are described in U.S. Pat. Nos. 4,993,130; 5,184,381; and 5,327,622 all to Coons, III et al.; and in pending U.S. patent application Ser. No. 08/622,196 filed on Mar. 25, 1996, allowed but not yet issued and Ser. No. 08/333,158 issued as U.S. Pat. No. 5,613,285 on Mar. 25, 1997.

Differently colored strands may be combined into plied yarns in several ways that usually involve the use of interlacing. Most of these processes are "two-step" processes meaning that the spun strands are wound up after the first step of spinning, drawing and perhaps texturing. The second step typically involves unwinding the strand in the entangling step where more than one strand is combined. These two-step process are slow and inefficient, primarily because of the extra wind-up step. Also, the speed of the process is limited because of the unwinding step. Even minor tension differences in the strands being unwound can cause major irregularities in the plied yarn. The unwinding speed must be slow enough for adequate tension control mechanisms to operate.

True space-dyeing involves dyeing strands with at least one color at varied irregular intervals. The space-dyeing process is slow and inefficient.

Heather yarns are an example of yarns made from differently colored or colorable filaments. Heather yarns display muted, mottled, mixed or diffused color. Usually, heather yarns give a one-color appearance when viewed from a distance, say, about five feet.

Space-dyed yarns, on the other hand, will give pin points of color even when viewed at large distances. (Of course, this is somewhat dependent on the colors used in the space-dyed yarn. If the different colors in the space-dyed yarns are very similar, then they will not be as noticeable. Heather yarns, however, have more blending among the several component color strands. All other things being equal, heather yarns appear uniformly colored when viewed at about 5 feet or more and space-dyed yarns demonstrate color pin points or segments.) This effect can be characterized as "color pop". The effect can be varied by varying the length of each color segment in the space-dyeing process.

Any elimination of processing steps, whether for the yarn manufacturer or the carpet mill, improves process efficiency. Many of the processes for making multicolor yarns do not result in a ready-to-tuft yarn. The carpet mills or a yarn converter must take these multicolor yarns, twist and "finish them" by interlacing or otherwise processing them to make a yarn that can be tufted into carpet.

U.S. Pat. No. 5,251,363 to Gerhards et al. describes a method and apparatus for producing multicolored crimped yarns. The method includes spinning a plurality of differently colored groups of filaments, subjecting the filaments of each group to a treatment liquid and then combining the filaments to form respective strands. Each strand is subjected to an air entangling process, then stretched and the strands are thereafter combined in a thermo-pneumatic texturing process.

U.S. Pat. No. 5,220,778 to Flachmueller et al. describes a method for producing untwisted yarns from at least two strands. Intermediate steps introduced between the main conventional steps of spinning, stretching and texturing allow the reciprocal position of the individual strands resulting from the arrangement of the spinnerets to be retained through the process. The patent states that a non-positively acting false twister for each individual fibril bundle also makes it possible to vary intermixing of the bundles in their contact zones.

U.S. Pat. No. 4,408,376 to Hatcher et al. pertains to the drawing of a plurality of yarns about draw rolls in adjacent untwisted relation. The invention is described as having particular application to the processing of yarn ends, each of which has a different color, which ends are to be subsequently twisted into a single yarn having uniform color properties throughout its length.

U.S. Pat. No. 4,025,595 to Mirhej describes that a range of continuous mixed filament texturing feed yarns will provide a range of fabrics having advantageous mixed filament characteristics that can be prepared in a single process when at least two different continuous filament yarns are co-spun and separately entangled. The process is described as providing yarns which will produce a whole spectrum of mixed filament effects in a fabric ranging from high contrast/high directionality to low contrast/low directionality.

U.S. Pat. No. 3,780,516 to Kimbrell describes a process for forming a yarn wherein a plurality of yarn ends pass from their respective yarn packages, are each wrapped about a common feed roll, passed from the feed roll through a heating zone, passed from the heating zone to a common heated draw roll, are wrapped about the heated draw roll and passed from the heated draw roll through apparatus for bringing the yarn ends into contact with one another in a pre-selected arrangement to form a resulting yarn which has improved properties caused by wrapping a selected one of the yarn ends about the heated draw roll a number of turns which is greater than the common number of turns the other yarn ends are wrapped about the draw roll.

SUMMARY OF THE INVENTION

The present invention provides a fast and efficient process for making ready-to-tuft, mock space-dyed yarn with a range of color pop. The process employs the sequential steps of: (a) extruding two or more strands having two or more colors in separated color blocks or combined color groupings such that the color of each strand is different than the color of at least one other strand; (b) combining the strands as necessary to create at least two fractions from the two or more strands; (c) independently texturing each fraction; (d) combining the fractions in an interlacer to yield a yarn that may be tufted directly into carpet without further texturing or twisting; and (e) winding up the yarn.

The present invention includes a process for making ready-to-tuft, mock space-dyed bulked continuous filament yarn employing the steps of: (a) extruding one or more strands having one or more colors; (b) drawing the one or more strands; (c) inserting one or more additional strands so that there is a total of at least two strands and the color of each strand is different than the color of at least one other strand; (d) combining the strands as necessary to create at least two fractions from the total; (e) independently texturing at least one fraction; (f) combining the fractions in an interlacer to yield a yarn that may be tufted directly into carpet without further texturing or twisting; and (g) winding up the yarn.

Additionally, the present invention includes an apparatus for making ready-to-tuft, mock space-dyed, bulked continuous filament yarn. This apparatus has means for extruding filaments into multifilament strand having two or more separated color blocks or combined color groupings such that the color of each strand is different than the color of at least one other strand; means for combining said strands as necessary to create at least two fractions from said two or more strands; means for independently texturing each fraction; and means for combining the fractions to yield a yarn that may be tufted directly into carpet without further texturing or twisting. The apparatus may also include means for inserting one or several strands.

It is an object of the present invention to provide a one step process for making ready-to-tuft, mock space-dyed multifilament yarn.

Another object of the present invention is to provide yarn mimicking the appearance of natural fibers such as wool.

A further object of the present invention is an apparatus for making ready-to-tuft, mock space-dyed, bulked continuous filament yarn.

Related objects and advantages of the present invention will be apparent to those of ordinary skill in the art after reading the following detailed description.

DETAILED DESCRIPTION OF THE PREFERRED EMBODIMENTS

Figure 1:
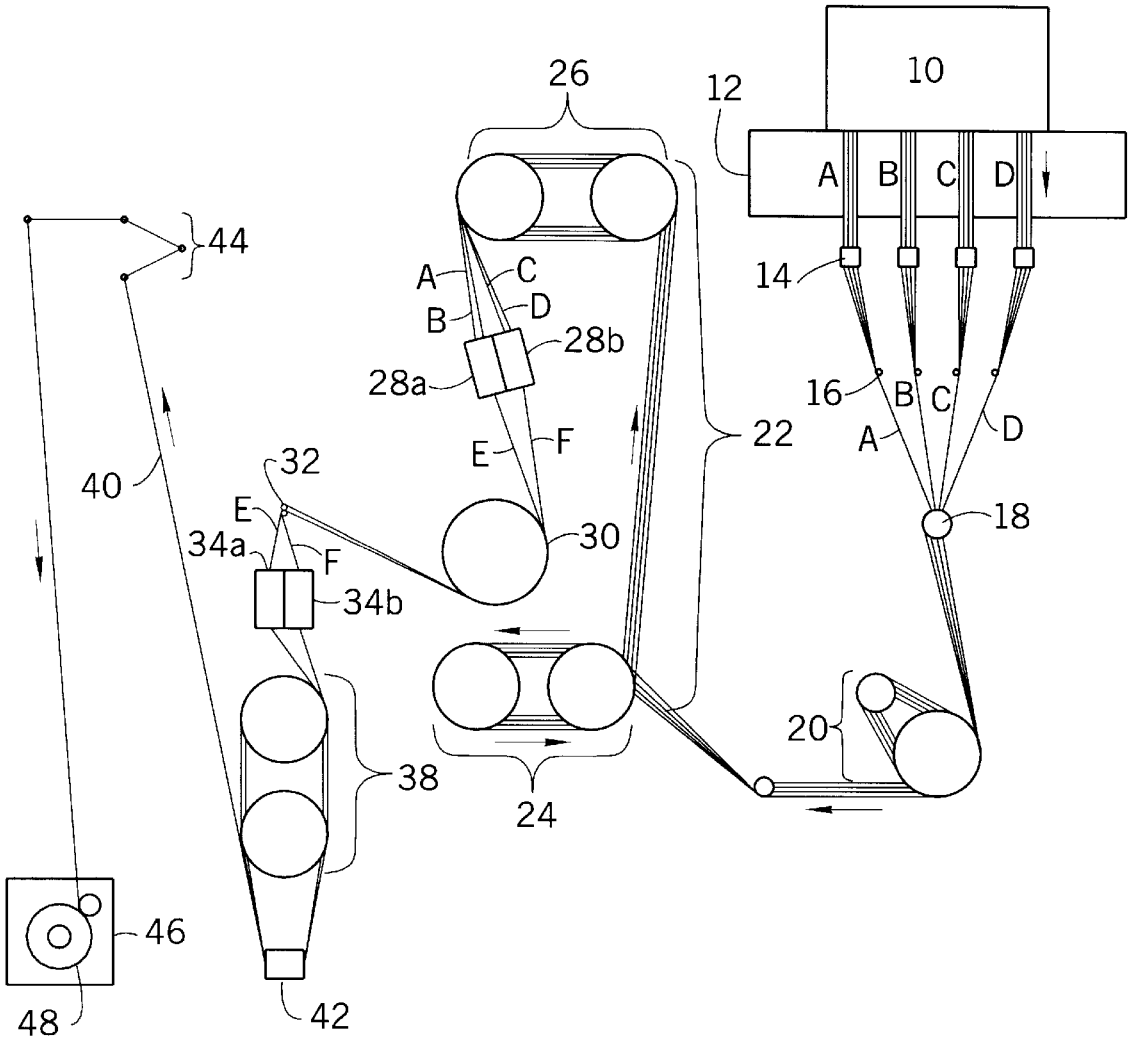
FIG. 1 schematically illustrates an apparatus according to the present invention.

To promote an understanding of the principles of the present invention, descriptions of specific embodiments of the invention follow and specific language is used to describe the same. It will be understood that no limitation of the scope of the invention is intended by the use of this specific language that alterations, modifications and further applications of the principles of the invention discussed are contemplated as would normally occur to one ordinarily skilled in the art to which the invention pertains.

The present invention is a process for making a ready-to-tuft, mock space-dyed, bulked continuous filament ("BCF") carpet yarn. The process of the present invention is very versatile and can be used to produce a variety of space-dyed yarn effects. In general, the process of the present invention produces yarn, that when tufted into carpet exhibits striking color pop. Of course, those of ordinary skill in the art will realize that color pop cannot be achieved when the separate strands of the yarn do not have sufficiently contrasting colors. However, even when the colors are not sufficiently contrasting, unique color affects are achieved in this one step process that could previously be achieved only in more laborious methods. The yarns made according to the present invention do not require additional twisting, interlacing or other processing steps to be suitable for tufting, although such steps may be used to give even more varied products. Also, yarns made according to the present invention can be twisted or otherwise combined with other more conventional yarns, including single color yarns, to yield a wide variety of unique color effects.

One embodiment of the present invention is a process with the sequential steps of extruding two or more strands having two or more colors in separated color blocks or combined color groupings such that the color of each strand is different than the color of at least one other strand. Two or more fractions are created from the two or more strands. At least one of these fractions is textured and, optionally, entangled separately from each other. Following entangling, the fractions are combined in an interlacer to yield a yarn that can be directly tufted into carpet without "finishing", i.e., further texturing, or other processing. The process uses at least one texturing jet per each fraction that is textured and one or two (or more) stages of interlacing after texturing. By selecting the total denier of one fraction to be low compared to the total denier of one or more other fractions, the degree of mock space-dyed appearance can be optimized. The process does not require false or real twisting.

The first step of the invention is extruding two or more strands having two or more different colors. The strands are made by extruding several groups of filaments in color blocks and combining the filaments into strands. The presently preferred method of extruding these different color blocks is described in U.S. Pat. No. RE 35,108 which is incorporated herein by reference for the multicolor spinning techniques and apparatus described therein. A variety of color groupings are possible in the individual strands. By way of illustration and not limitation, each strand may be a different color or color set; more than one strand may be the same color and the remaining strand of a different color; one or more of the strands may be a random or controlled mix of several colors or hues; etc. The currently preferred extrusion speed is about 2 to about 9 grams/minute/filament.

The strands need not be made of the same materials but they should be compatible with each other with respect to shrinkage, crimp level attainable at a given condition, etc., unless of course, unique effects from such differences are desired. By way of illustration, an undrawn fraction may be inserted after the drawing step of the process to provide a unique effect.

The filaments of the strands extruded according to the present invention may be any man-made filaments made from fiber forming thermoplastic materials especially polyesters, polyamides and polyolefins. Suitable polyesters include (but are not limited to) poly(ethylene terephthalate), poly(butylene terephthalate) and copolymers and mixtures thereof. Suitable polyamides include (but are not limited to) nylon 6, nylon 6/6, nylon 6/9, nylon 6/10, nylon 6/12, nylon 11, nylon 12 and copolymers and mixtures thereof. Suitable polyolefins include polypropylene, polypropylene derivatives, and copolymers and mixtures thereof. The ordinarily skilled artisan will recognize that the process conditions, e.g., temperatures, draw ratios, etc., will vary according to the standard operating procedures for fibers of the type being spun. The fibers of the strands may be multicomponent or monocomponent fibers and have any variety of arrangements of the components, like sheath-core, islands-in-the-sea, side-by-side, etc. The individual filaments may be of any cross-sectional shape, e.g., round, multilobal, hexagonal, elongated, hollow, etc.

Of course, various additives may be used in one or more of the filaments. These include (without limitation) lubricants, nucleating agents, antioxidants, ultraviolet light stabilizers, pigments, dyes, antistatic agents, soil resists, stain resists, antimicrobial agents and flame retardants.

The fibers may be colored in the melt according to any of the conventional processes for doing so. Melt coloration, also called solution dying is preferable. The fibers may also be natural color as spun and differ from each other with respect to dyeability so that after dyeing the unique color effect is displayed. It is preferred that melt coloration be used but reference to melt coloration and differences in the colors of the as spun fibers should not be considered limiting. The differences in color or colorability can be accomplished by conventional methods of coloring the fiber forming polymer in the melt or by providing differential dyeability, such as by making one feed yarn from regular anionic dye dyeable nylon and the other yarn from cationic dye dyeable nylon, all according to methods well known to those in the art.

Preferably, each strand will have a total denier between 300 and 3300 and a denier per filament between 10 and 30 such as typically found in yarns made for tufting into carpet. More preferably, the strands between 450 and 1400 and a denier per filament between 15 and 28. The strands may have a different number of filaments per strand (filament count) or total strand denier to create desired effects in the final yarn product. For example, the larger the individual strand, the more propensity for that strand to become vivid in the yarn.

Following extrusion, the filaments are quenched. A finish suitable for the type of fiber (e.g., nylon 6) may be applied using a number of finish applicators corresponding to the number of strands.

The strands are guided separately, possibly using a grooved roller, to and from the draw rolls. The groups are drawn in side-by-side fashion at a draw ratio suitable for the type of filament. A series of guide pins may also be used. These pins are preferably ceramic but can be made of other materials as well. Preferably, these pins are grooved and not flat. The grooves help to stabilize the components and prevent them from jumping together before the texturing jet.

The drawing step of the present invention can be accomplished using any conventional draw ratio for the type of fiber being made. When the yarn is nylon 6 yarn, the draw ratio is preferably about 3. But the desirable draw ratio will be apparent to those of ordinary skill in the art. Drawing preferably includes passing each feed yarn over heated draw rolls paired with grooved separator rolls where the separator rolls, when used, have at least one grooved path for each strand to keep them separate during drawing. Most preferably, these grooved paths are rounded.

Following drawing, one or more of the strands are textured. Some of the strands may be combined in the texturing step to achieve special yarn color effects. The strands are combined as necessary to create fractions, at least one of which is routed independently of the other fractions to the texturing jet. One jet should be used for each fraction to be textured. It is currently preferable that the texturing step operates on at least two fractions and is accomplished with at least two jets, also called "twin jets", that operate on different fractions independently of each other. Those of ordinary skill in the art will recognize that the texturing jet should be sized in proportion to the operating denier of the fraction being textured. A great deal of flexibility in the color effect of the final yarn product is possible in the texturing step. The strands can be combined in several ways. The selection of the colors of the strands combined is a determining factor in the appearance of the yarn product. For example, one or more differently colored strands can be combined in each color block. The conditions for texturing will depend to a degree on the yarn being textured. Exemplary texturing conditions for nylon 6 yarn are: air temperature of about 215° C.; duo 2 (second draw rolls) temperature of about 115° C. to about 165° C.; texturing jet pressure of about 6 to about 10 bar.

The hot texturing step of the present invention is preferably accomplished using a thermo-pneumatic stuffer box (in this case a jet) but other texturing methods can be used. In such a stuffer jet, the yarn is crimped (mechanically bent and folded) because it is supplied into the jet assembly faster than it is withdrawn. Warm air with a temperature sufficient to set the crimp is used. In the case of nylon 6, a preferable range of suitable air temperatures is in the range of about 180° C. to about 230° C.

The textured fractions can then be separately interlaced. This step is optional depending on the desired result. If there are more than two fractions, it is possible that some of them may be combined or they may be handled separately. Further, it is not necessary that any fraction be interlaced, i.e., any number of the fractions between zero and all may be independently interlaced after texturing. The interlacing step is preferably carried out between a yarn cooling zone and godet and/or used in conjunction with an intermingling jet prior to a yarn winding device. A preferred jet is supplied by Temco (LD 32 series) and allows for selection of the intermingling jet at an appropriate size for the yarn strand(s).

Next the fractions are combined into a bundle and the entire bundle is interlaced as a unit before being wound on a bobbin. The resulting wound yarn may be tufted directly into carpet without further texturing or twisting. When fractions are not independently interlaced after texturing, then the combining step (by interlacing) proceeds more or less following texturing. The preferred winding speed is about 1,000 to about 3,400 meters per minute.

The yarn made by the process of the present invention will typically (but not by way of limitation) have from about 30 to about 50 tangles per meter, preferably from about 33 to about 42. The yarn seeing two interlacing steps will generally have more tangles per meter. Although the yarn made by the process of the present invention may be used directly without twisting or additional texturing, additional twisting or texturing may be employed to create still further novel color effects in the yarn—and then in the carpet. When used directly without these additional steps, the yarn made by the process of the present invention is cost effective and provides esthetically pleasing "color pop" as desired in popular styles. It should be appreciated that the process of the present invention is not limited to yarns that display such color pop. More muted or blended color effects are also possible—all in a one-step process.

Another embodiment of the present invention involves a modification of the above process. It is possible to insert a strand, fraction or yarn in the process. Also, it is possible to use insertion techniques to create the novel color effects of the yarn made by the process of the present invention. For example, a single color one-step spinning process may be modified by inserting differently colored or colorable strands or fractions in the process. The point of insertion will depend on the physical properties of the inserted yarn and the desired appearance in the carpet. Undrawn feed yarn will normally, but not necessarily, be inserted before the drawing step. Fully drawn flat yarn (or even undrawn yarn) may be inserted after the texturing step but before the final interlacing step. The inserted strand may be combined with a strand of the freshly spun yarn to make a fraction. This fraction will be processed separately from at least one other fraction, and so on.

Other yarns can be inserted in the process. For example, in either embodiment of the invention described above, antistatic yarn can be inserted to provide static discharge protection in the carpet.

Another embodiment of the present invention is an apparatus for making one-step, ready-to-tuft, mock space-dyed yarn. The apparatus will now be described in more detail with reference to the figures. It should be understood that the description of the apparatus enhances the description of the process.

FIG. 1 is a schematic of the apparatus of the present invention. Spinning head 10 is shown spinning four strands A, B, C and D. Four strands are shown merely for illustration. More or less strands may be spun as desired for the final yarn product. Each strand is composed of several filaments depending in number, again, on the desired end product. The strands are quenched in quench zone 12. The preferable spinning head is described in U.S. Pat. No. RE 35,108, previously incorporated herein by reference.

Finish applicators 14 are present to apply the desired spin finish. Although one applicator per strand is shown, a single applicator could be used.

Guides 16 combine the individual filaments to better cohere each strand by friction. Guide 18 may have one or several grooves to guide each strand to pretensioning godet 20. The pretensioning godet prevents slippage of the filaments on the draw rolls and stabilizes filament movement.

Each strand is supplied to draw zone 22 separate side-by-side parallel relationship to each other. Draw zone 22 includes two sets of duos. First set of duos 24 heats each strand. Second set of duos 26 is moving faster than the first set, heats the yarn further for obtaining the desired bulk and draws the strands. By adjusting the relative speeds of the duos, the draw ratio of the oriented yarn is established.

Individual strands are then combined by the apparatus in bulking (texturing) jets 28*a* and 28*b*. Although two bulking jets are shown, this should not be considered limiting. As many jets can be used as are needed to achieve the desired result. There will be, however, at least one jet for each fraction to be textured. In FIG. 1, strands A and B are combined in bulking jet 28*a*. The bulked combined strands A and B make fraction E. Strands C and D are combined in bulking jet 28*b*. The bulked combined strands C and D make fraction F. The currently preferred bulking jet is supplied by Rieter Corporation, for example, types V-808 or 616 are satisfactory. It should be noted that the combinations of the strands described are for illustration purposes only and are not limiting. For example, three of the strands could be combined in the bulking jet and the remaining one bulked separately or separate jets can be used for each strand.

The bulked fractions are then cooled. Cooling drum 30 is shown for this purpose but other methods of cooling can be used.

Optionally, the cooled fractions are guided over guide 32 separately to one or several first stage interlacers. Two first stage interlacers 34*a* and 34*b* FIG. 1 are shown. Exemplary suitable interlacers are Temco LD32 jets. Duo 38 controls the tension into the interlacers 34*a* and *b*, the plug length on cooling drum 30 and the winding tension. The interlacers used in the process of the present invention may operate in the exemplary air pressure range of about 5 to about 10 bar, depending on the desired end result.

The fractions are then combined into ready-to-tuft bundle 40 using second stage interlacer 42. Currently, the preferred interlacer is a Temco LD32 jet.

Yarn 40 is guided by tension control guide group 44 to winder 46 where it is wound up on package 48.

Figure 2:
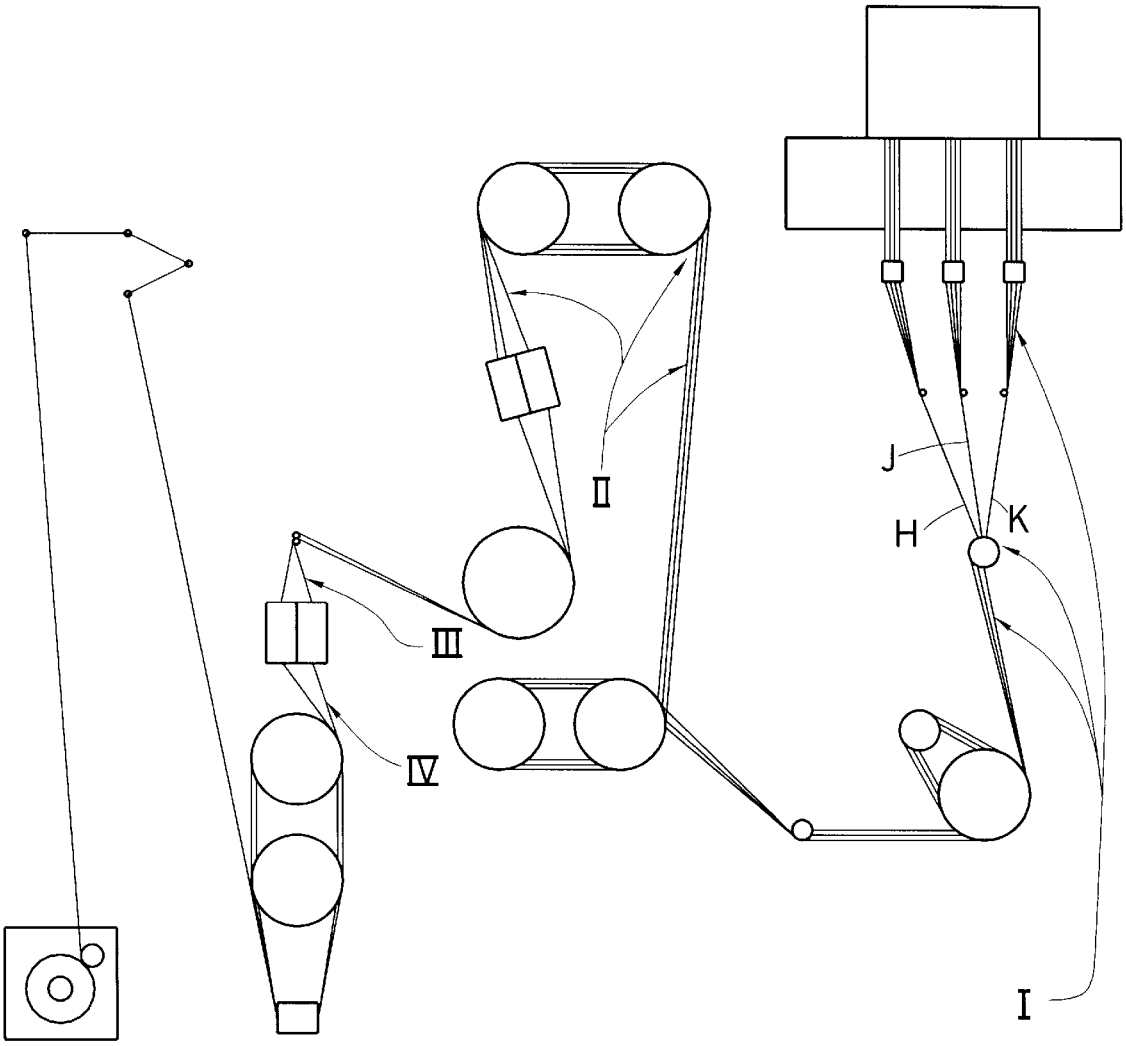
FIG. 2 schematically illustrates insertion points in an apparatus according to the present invention.

FIG. 2 shows an apparatus of the present invention modified for insertion of strands. Three strands, H, J and K, are spun and processes generally as described in connection with FIG. 1. In fact, the entire process proceeds as described in FIG. 1 except that other strands may be inserted at locations I, II, III or IV (or some or all of these locations). It should be understood that these locations are indicated approximately in the figure and no limitation is intended by showing the locations. For example, Location I is before drawing and may be accomplished at several positions before the drawroll, e.g., at the finish applicator, at the pretensioning godets or at one of the guides present before the drawrolls. Location II is before texturing and Location III is before optional first stage interlacer. Location IV is before the tensioning duo and after the air interlacer. Useful insertion techniques may be any that are known to those ordinarily skilled in the art.

The yarn produced on the apparatus of the present invention shows a variety of unique color effects depending on the colors of the strands and the manner in which they are combined and interlaced. Yam made according to the present invention is advantageously used in making carpets. Without meaning to be limited by listing yarn properties, the yarns made according to the present invention will typically have the following properties: denier in grams per 9000 meters: about 1800–4000; denier per filament: about 16–28; tenacity:>about 2.5; elongation: about 30–60; % wet bulk: about 5–25; and tangles/meter about 5–50. Carpets made from this yarn can have clean bold colors that appear randomly as chunks ( i.e., space-dyed look).

This invention will be described by reference to the following detailed examples. The examples are set forth by way of illustration, and are not intended to limit the scope of the invention. While the Examples use four color blocks, it should be readily understood that more than four (e.g., 6, 7, 8 or more) or less than four (2 of 3) can be used and combined in a variety of ways to create numerous different color effects. Also, the two variations of the method of the present invention can be used together. For example, it is contemplated that four color blocks can be processed according to the first variation and two color blocks can be processed by inserting them. The resulting yarn has six color blocks or strands.

Comparative Example A

Four solution-dyed nylon polymer streams are separately fed into a spin pack described in U.S. Pat. No. RE 35,108 and are extruded in uniformly proportioned strands of 34 filaments each. The colors are fawn, cedar, natural canvas and black. Each block occupies one fourth of the rectangular spinneret's area. The extruded filaments are quenched before finish is applied separately to the strands. The strands are combined into yarn on the draw rolls, drawn at a draw ratio of 3.2 and then textured using a single texturing jet. Finally, the yarn is air interlaced before take-up on a winder at 1,650 mpm. The 2500 denier/136 filament yarn is ready for tufting. Typical carpet construction of tenth gauge, ⅜" height, level loop, 18 ounces/square yard is carried out.

Comparative Examples B & C

Yarn is prepared as in Comparative Example A with the following differences. The take-up speed is 1,500 mpm. The total yarn denier is 3600. The proportioned color block distribution for Comparative Example B is 48, 48, 24, 24=144 filaments. The colors of each block are fawn, cedar, natural canvas and black, respectively. The proportioned color block distribution for Comparative Example C is 72, 24, 24, 24=144 filaments. The colors are fawn, cedar, natural canvas and black, respectively.

Invention Example 1

As in Comparative Example A, four solution-dyed nylon 6 polymer streams are fed separately into the spin pack, extruded as filaments in color blocks, quenched and combined into four differently colored strands. Individual strands are supplied with finish. The four strands run side-by-side around the draw rolls which are running at speeds to achieve a draw ratio of 3.4. The strands are combined into two uniform fractions (referring to number of filaments and denier). Fawn and cedar are combined. Natural canvas and black are combined. Each fraction is separately textured by a texturing jet. One fraction goes to one texturing jet and the other fraction goes to the other texturing jet. The twin textured fractions are cooled, combined and air interlaced before being wound on a bobbin at 1,650 mpm. All other processing conditions are the same as Comparative Example A except the texturing jet size is changed in proportion to the operating denier as known by those skilled in the art.

Invention Example 2

Twin Jet Texturing Process

The process is the same as Example 1, except that the color blocks are split into two fractions similar to Comparative Example B: 48+48 (fawn and cedar) filament blocks as one fraction; and 24+24 (natural canvas and black) filament blocks as the other fraction. Each fraction is separately textured before being combined by air interlacing into one bundle. The yarn is then wound at 1500 mpm into a ready-to-tuft yarn package.

Invention Example 3

Twin Jet Texturing and Added Air Interlacing

The process is the same as Invention Example 2, except that each twin jet textured bundle is separately air interlaced before being combined by air interlacing into a single 3600 denier bundle.

Invention Example 4

Twin Jet Texturing and Added Air Interlacing

The process is the same as Invention Example 2 except that there is added, directly after the twin jet texturing and cooling step, an air interlacing step. The take-up speed, denier and color block distribution are as in Comparative Example C. Each two color textured fraction is air interlaced prior to being combined with each other into a single bundle. The bundle is combined by air interlacing in a second step before being wound into a ready-to-tuft package.

Invention Example 5

Twin Jet Texturing Process

The process is the same as Invention Example 2, except that the strands are split into the following two groups: three strands (48,48 (fawn, cedar) and 24 (natural canvas) (total denier=3000)) strands into one texturing jet; and the remaining 24 filament (black) strand (600 denier) into another texturing jet.

Invention Example 6

Twin Jet Texturing Process

The process is the same as Example 5, except that the strand filament numbers are now 72 (fawn), 24 (cedar), 24 (natural canvas), 24 (black)=(144 filaments). The black strand is processed and textured separately.

Invention Example 7

Twin Jet Texturing Process

The process is the same as Example 6, except that the denier per filament of one 24 filament strand (black) is reduced to give it a bundle denier of 360. The denier of each of the other three strands are slightly increased (3240 denier) so that the yarn is still 3600 denier.

Invention Example 8

Twin Jet Texturing and Added Air Interlacing

The process is the same as Example 6, except that each separate twin textured fraction is air interlaced prior to being combined and then air interlaced into a single 3600 denier bundle.

Invention Example 9

Strand Insertion

The process is similar to Invention Example 5, except that a 720 denier undrawn black trilobal filament strand is inserted after the texturing jet but before the tensioning duo. This inserted strand is combined with a fraction of co-textured fawn (48 filaments), cedar(48 filaments) and natural canvas(24 filaments). The combination is interlaced and wound on a package at 1500 mpm. The undrawn black insert provides a lustrous black fleck.

Comparative Example B is characterized by a dark dulling continuous overcast to the other hues caused by the black strand. Examples 5–7 exhibit black as a distinct black fleck. Example 6 is characterized by a wool-like appearance due to the 72 filament fawn strand and reducing the contribution of the cedar strand from 48 to 24 (compared to Example 5). In Example 7, the denier per filament of the black strand was changed to cause the total strand denier to decrease from 600 denier to 360 denier to achieve a smaller black fleck. By adding the separate air interlacing step after the twin jet texturing and cooling, as in Example 8, the separate textured bundles are distinct, showing a striking color pop for each color. The black fleck is most distinct. The undrawn black strand inserted in Example 9 provides another unique appearance. The light reflectance and absorption properties of this undrawn insert provide a comparatively lustrous look to the yarn.

Comparative Example D

A nylon 6 yarn is made as in Comparative Example A by spinning four solution-dyed blocks and routing them together through the same texturing jet and air interlacing. The color block sizes are 48, 48, 24 and 24=144 filaments. The colors are taupe, black, turquoise and bay blue, respectively. 2500 denier yarn is made.

Invention Example 10

Using the colors of Comparative Example D and the conditions of Invention Example 1, two by two color twin jet textured yarn is made. One fraction is the taupe with black and is textured in one jet. The turquoise strand and bay blue strand are textured together in the other jet. The wind-up speed is 1700 mpm.

Invention Example 11

The process of Example 10 is practiced except that each textured fraction is separately air interlaced before being combined.

Invention Example 12

In Example 12 a ready-to-tuft yarn is made by segregating the four colors; texturing three of the strands together in one jet; and texturing the bay blue strand by itself in another jet.

Compared to Comparative Example D, the yarns of Examples 10–12 show considerable color pop. The color pop is most striking in yarn prepared with the added air interlacing step of Example 11. In the 1×3 twin jet texturing of Example 12, the bay blue strand is quite distinct compared to Comparative Example D.

What is claimed is:

1. A process for making ready-to-tuft, mock space-dyed bulked continuous filament yarn comprising the sequential steps of:

(a) extruding two or more strands having two or more colors in separated color blocks or combined color groupings such that the color of each strand is different than the color of at least one other strand;

(b) combining said strands to create at least two fractions from said two or more strands;

(c) independently texturing at least one fraction;

(d) combining the fractions in an interlacer to yield a yarn suitable for tufting directly into carpet without further texturing or twisting; and (e) winding said yarn after said combining step (d).

2. The process of claim 1 further comprising the step of:

(f) independently interlacing at least one fraction between said texturing and said combining step (d).

3. The process of claim 1 wherein said winding is at a speed of about 1000 to about 3400 meters per minute.

4. The process of claim 1 wherein said extruding is of three or more differently colored strands.

5. The process of claim 1 wherein said texturing is accomplished independently with at least two bulking jets operated in parallel and at least two of said fractions are guided separately to a respective bulking jet.

6. The process of claim 2 wherein said independently texturing is of less than all fractions.

7. The process of claim 2 wherein said winding is at a speed of about 1000 to about 3400 meters per minute.

8. The process of claim 2 wherein said extruding is of three or more differently colored strands.

9. The process of claim 2 wherein said texturing is accomplished independently with at least two bulking jets operated in parallel and at least two of said fractions are guided separately to a respective bulking jet.

10. A process for making ready-to-tuft, mock space-dyed bulked continuous filament yarn comprising the steps of:

(a) extruding one or more strands having one or more colors;

(b) drawing one or more strands;

(c) inserting one or more additional strands so that there is a total of at least two strands and the color of each strand is different than the color of at least one other strand;

(d) combining strands to create at least two fractions from the total;

(e) independently texturing at least one fraction;

(f) combining the fractions in an interlacer to yield a yarn suitable for tufting directly into carpet without further texturing or twisting; and (g) winding said yarn after said combining step (f).

11. The process of claim 10 wherein said inserting is of a strand comprised of undrawn filaments and occurs before said drawing.

12. The process of claim 10 wherein said inserting is of a strand comprised of undrawn filaments and occurs after said drawing.

13. The process of claim 10 wherein said inserting is of a strand comprised of drawn filaments and occurs before said texturing.

14. The process of before claim 10 wherein said inserting is of a strand comprised of drawn filaments and occurs after said texturing.

15. The process of claim 13 wherein said drawn filaments are combined into a fraction with at least one of the strands from said extruding.

16. The process of claim 10 where said inserting occurs after said texturing and before said combining step (f).

17. The process of claim 10 wherein said winding is at a speed of about 1000 to about 3400 meters per minute.

18. The process of claim 10 wherein said texturing is accomplished independently with at least two bulking jets operated in parallel and at least two of said fractions are guided separately to a respective bulking jet.

19. The process of claim 10 further comprising the step of:

(h) independently interlacing at least one fraction between said texturing and said combining step (f).

20. The process of claim 19 wherein said inserting occurs after said texturing and prior to said independent interlacing step (h).

* * * * *